US008759752B2

(12) United States Patent
Remes

(10) Patent No.: US 8,759,752 B2
(45) Date of Patent: Jun. 24, 2014

(54) CORRECTED MASS ANALYTE VALUES IN A MASS SPECTRUM

(75) Inventor: Philip M. Remes, Berkeley, CA (US)

(73) Assignee: Thermo Finnigan LLC, San Jose, CA (US)

( * ) Notice: Subject to any disclaimer, the term of this patent is extended or adjusted under 35 U.S.C. 154(b) by 179 days.

(21) Appl. No.: 13/417,558

(22) Filed: Mar. 12, 2012

(65) Prior Publication Data

US 2013/0234014 A1 Sep. 12, 2013

(51) Int. Cl.
*H01J 49/00* (2006.01)

(52) U.S. Cl.
USPC ..... 250/282; 250/281; 250/288

(58) Field of Classification Search
USPC ..... 250/282
See application file for complete search history.

(56) References Cited

U.S. PATENT DOCUMENTS

| | | | | |
|---|---|---|---|---|
| 5,397,894 | A * | 3/1995 | Wells et al. | 250/282 |
| 5,420,425 | A | 5/1995 | Bier et al. | |
| 5,559,325 | A | 9/1996 | Franzen | |
| 6,147,344 | A * | 11/2000 | Annis et al. | 250/281 |
| 6,627,876 | B2 | 9/2003 | Hager | |
| 6,884,996 | B2 | 4/2005 | Senko | |
| 7,692,142 | B2 | 4/2010 | Schwartz et al. | |
| 7,700,912 | B2 | 4/2010 | Amster et al. | |
| 7,804,065 | B2 | 9/2010 | Remes et al. | |
| 8,101,908 | B2 | 1/2012 | Senko | |
| 2011/0165694 | A1 * | 7/2011 | Krumwiede | 436/173 |

FOREIGN PATENT DOCUMENTS

| | | | |
|---|---|---|---|
| EP | 2385543 | A1 | 11/2011 |
| WO | 2006130787 | A2 | 12/2006 |

OTHER PUBLICATIONS

Easterling et al., "Routine part-per-million mass accuracy for high-mass ions: space-charge effects in MALDI FT-ICR," Analytical Chemistry, 71(3), 624-632, 1999.
Leach et al., "Comparison of particle-in-cell simulations with experimentally observed frequency shifts between ions of the same mass-to-charge in fourier transform ion cyclotron resonance mass spectrometry," 21(2), 203-208, 2010.
Masselon et al., "Mass measurement errors caused by 'local' frequency perturbations in FTICR mass spectrometry," Journal of the American Society for Mass Spectrometry, 13(1), 99-106, 2002.
Wong et al., "Experimental evidence for space-charge effects between ions of the same mass-to-charge in Fourier-transform ion cyclotron resonance mass spectrometry," Int'l Journal of Mass Spectrometry, 265(2-3), 99-105, 2007.

(Continued)

*Primary Examiner* — Phillip A Johnston
(74) *Attorney, Agent, or Firm* — Timothy J. Ohara

(57) ABSTRACT

A method for determining a mass-to-charge ratio of an analyte is described that accounts for space charge limitations when there are relatively high concentrations of ions in an ion trap. The method includes calibrating a mass spectrometer for the space charge effects caused by the analyte ion itself and also for adjacent ions that have a mass-to-charge ratio different than the analyte ion. A mass spectrum can be measured for both an analyte ion and an adjacent ion where there is a relatively high concentration of ions in the ion trap. A corrected mass-to-charge ratio can be calculated for an analyte ion based on the measured analyte mass-to-charge ratio, the measured analyte abundance, the first mass-to-charge ratio difference, and the measured first adjacent ion abundance. The resulting corrected mass-to-charge ratio has an increased accuracy and at the same time improves the dynamic range of the ion trap mass analyzer.

18 Claims, 10 Drawing Sheets

(56) References Cited

OTHER PUBLICATIONS

Zhang, L-K et al., "Accurate mass spectrometry," Mass Spectrometry Reviews, 24(2), 286-309, 2004.

Cox et al., "Mass shifts and local space charge effects observed in the quadrupole ion trap at higher resolution," International Journal of Mass Spectrometry and Ion Processes, Elsevier, vol. 144, p. 47-65, (1995).

Schwartz et al., "A two-dimensional quadrupole ion trap mass spectrometer," J. Am. Soc. Mass. Spectrom., Elsevier, vol. 13, p. 659-669, (2002).

Second, et al., "Novel dual-pressure linear ion trap mass spectrometer offers breakthrough performance in proteomics experiments," Proteome Digest, Issue 9, Sep. 2009, Thermo Scientific Application Note: 462, p. 1-7.

A comprehensive study of space charge and peak splitting in the quadrupole ion trap, poster, presented at the Proceedings of the 49th ASMS Conference on Mass Spectrometry and Allied Topics, Chicago, IL, May 27-31, 2001.

* cited by examiner

CORRECTED MASS ANALYTE VALUES IN A MASS SPECTRUM

BACKGROUND

Quadrupole ion trap mass analyzers are widely employed for mass spectrometric analysis of a variety of substances, and are characterized by their high sensitivity and ability to perform multiple stages of isolation and fragmentation, commonly referred to in the art as $MS^n$. In a quadrupole ion trap mass analyzer, ions are confined by oscillatory fields generated by the application of suitable voltages to the ion trap and mass-sequentially ejected to a detector (e.g., by the method of resonance ejection) for acquisition of a mass spectrum. In addition to the electric fields generated by the applied voltages, the ions are also subject to and influenced by electric fields that are generated in the ion trap by the ions themselves. The self-generated electric fields have a characteristic strength that increases with the density of the ion population. The presence of non-trivial self-generated electric fields has a substantial effect on ion behavior, particularly with respect to resonant ejection, which may adversely impact the mass accuracy of the ion peaks detected in the mass spectrum.

In order to avoid or minimize the degradation of performance associated with self-generated electric fields, ion trap mass analyzers are conventionally operated with ion populations for which the self-generated electric fields are substantially smaller than the applied electric fields (i.e., the main trapping and resonant excitation fields). Thus, the maximum density of the ion population is set to a value at which self-generated fields do not appreciably influence ion behavior. Such limits are known as space charge limits.

Operation of ion trap mass analyzers below the space charge limit, while producing acceptable mass accuracy, has the undesirable effect of reducing instrument dynamic range. It may be desirable, particularly when measuring substances present over a large range of concentrations, to fill the ion trap with relatively greater numbers of ions. Filling the trap with greater numbers of ions also increases the ratio of signal to noise, resulting in a more reliable measurement. Thus, there is a need in the mass spectrometry art for a technique to perform mass analysis of a large ion population without sacrificing mass accuracy.

SUMMARY

A method of determining a mass-to-charge ratio of an analyte in a sample includes obtaining a mass spectrum, where the mass-to-charge ratio of the analyte was measured in a presence of a first adjacent ion. The first adjacent ion includes an ion having a mass-to-charge ratio that is different than the mass-to-charge ratio of the analyte. The mass spectrum includes a measured analyte mass-to-charge ratio, a measured first adjacent ion mass-to-charge ratio, a measured analyte abundance, and a measured first adjacent ion abundance. Next, a first mass-to-charge ratio difference can be determined by subtracting the measured first adjacent ion mass-to-charge ratio from the measured analyte mass-to-charge ratio. A corrected analyte mass-to-charge ratio can be calculated based on the measured analyte mass-to-charge ratio, the measured first analyte abundance, the first mass-to-charge ratio difference, and the measured first adjacent ion abundance.

The method of determining the mass-to-charge ratio of an analyte can also include determining a self charge space correction based on the measured analyte mass-to-charge ratio and the measured first analyte abundance. An adjacent ion space charge correction can be determined based on the first mass-to-charge ratio difference and the measured first adjacent ion abundance. The self charge space correction and the adjacent ion space charge correction can be summed together to form a space charge correction. The corrected analyte mass-to-charge ratio can be calculated by adding together the space charge correction and the measured analyte mass-to-charge ratio.

The method of determining the mass-to-charge ratio of an analyte may also correct for more than one species of adjacent ions. A species represents an adjacent ion having a particular m/z value. The mass-to-charge ratio of the analyte can be measured in a presence of both the first adjacent ion and a second adjacent ion. The first adjacent ion includes an ion having a mass-to-charge ratio that is different than the mass-to-charge ratio of the analyte and of the second adjacent ion. The second adjacent ion includes an ion having a mass-to-charge ratio that is different than the mass-to-charge ratio of the analyte and of the first adjacent ion. The method further includes determining a second mass-to-charge ratio difference by subtracting the measured second adjacent ion mass-to-charge ratio from the measured analyte mass-to-charge ratio. An adjacent ion space charge correction can be determined based on the first mass-to-charge ratio difference, the second mass-to-charge ratio difference, the measured first adjacent ion abundance, and the measured second adjacent ion abundance.

A method of determining a mass-to-charge ratio of an analyte in a sample can also be performed where the self space charge effect is relatively low. This method includes obtaining a mass spectrum, where the mass-to-charge ratio of the analyte was measured in a presence of a first adjacent ion. The first adjacent ion includes an ion having a mass-to-charge ratio that is different than the mass-to-charge ratio of the analyte. The mass spectrum includes a measured analyte mass-to-charge ratio, a measured first adjacent ion mass-to-charge ratio, and a measured first adjacent ion abundance. Next, a first mass-to-charge ratio difference can be determined by subtracting the measured first adjacent ion mass-to-charge ratio from the measured analyte mass-to-charge ratio. A corrected analyte mass-to-charge ratio can be calculated based on the measured analyte mass-to-charge ratio, the first mass-to-charge ratio difference, and the measured first adjacent ion abundance.

The method of determining the mass-to-charge ratio of an analyte can also include determining an adjacent ion space charge correction based on the first mass-to-charge ratio difference and the measured first adjacent ion abundance. The corrected analyte mass-to-charge ratio can be calculated by adding together the adjacent ion space charge correction and the measured analyte mass-to-charge ratio.

A system to determine a mass-to-charge ratio of an analyte in a sample includes a mass spectrometer and a microprocessor. The mass spectrometer can be configured to measure a mass spectrum of the analyte in a presence of a first adjacent ion. The first adjacent ion includes an ion having a mass-to-charge ratio that is different than the mass-to-charge ratio of the analyte. The mass spectrum includes a measured analyte mass-to-charge ratio, a measured first adjacent ion mass-to-charge ratio, a measured analyte abundance, and a measured first adjacent ion abundance. The microprocessor can be configured to receive the mass spectrum from the mass spectrometer and to output a corrected analyte mass-to-charge ratio based on the measured analyte mass-to-charge ratio, the measured analyte abundance, the measured first adjacent ion mass-to-charge ratio, the measured first adjacent ion abundance, and a first mass-to-charge ratio difference between the measured first adjacent ion mass-to-charge ratio and the measured analyte mass-to-charge ratio.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention (wherein like numerals represent like elements). A detailed understanding of the features and advantages of the present invention will be obtained by reference to the following detailed description that sets forth illustrative embodiments, in which the principles of the invention are utilized, and the accompanying drawings of which.

DETAILED DESCRIPTION OF EMBODIMENTS

The following detailed description should be read with reference to the drawings, in which like elements in different drawings are identically numbered. The drawings, which are not necessarily to scale, depict selected embodiments and are not intended to limit the scope of the invention. The detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. As used herein, the terms "about" or "approximately" for any numerical values or ranges indicate a suitable dimensional tolerance that allows the part or collection of components to function for its intended purpose as described herein.

Figure 1:
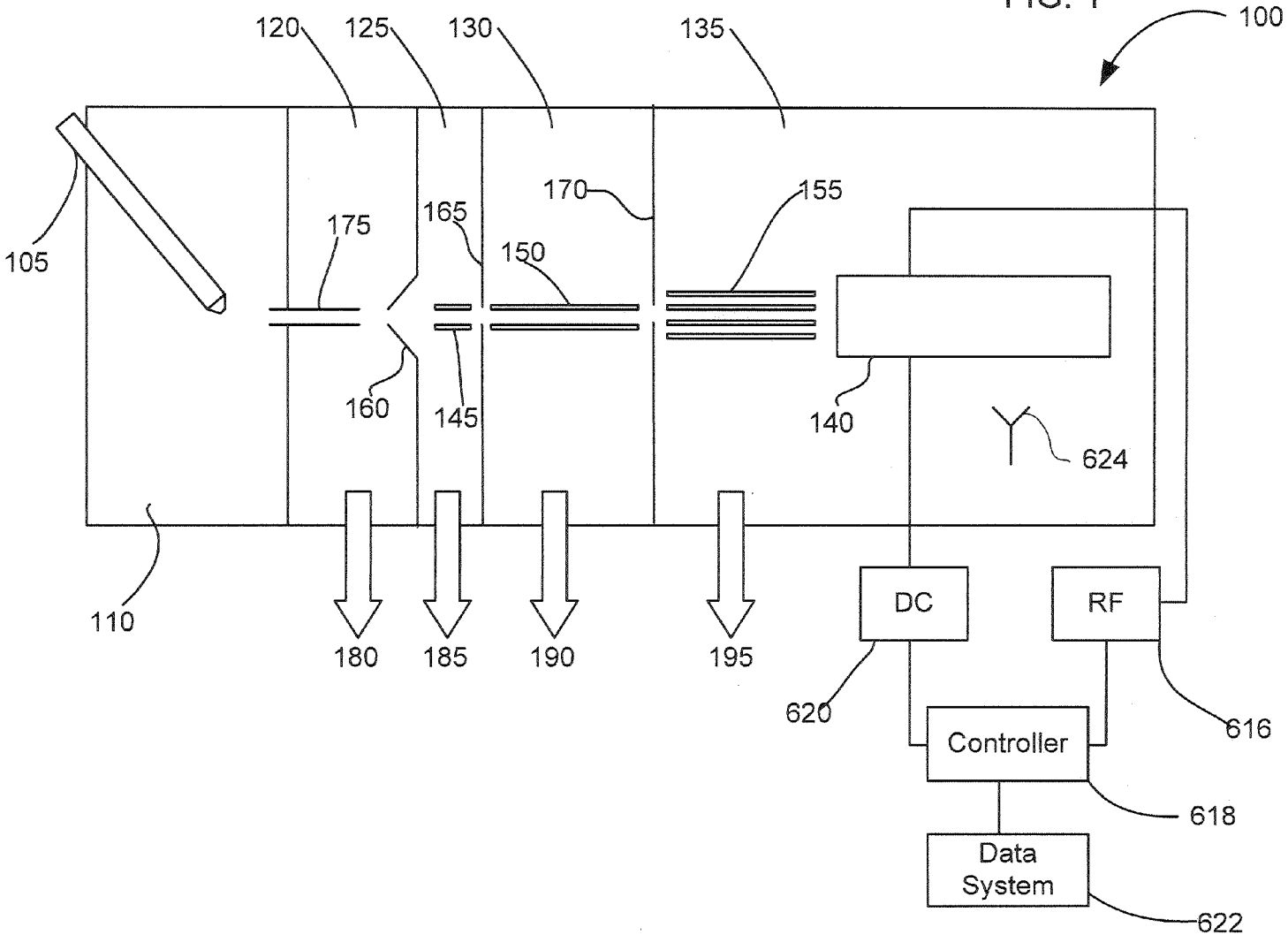
FIG. 1 illustrates a schematic view of a mass spectrometer suitable for use in obtaining a mass spectrum of an analyte ion in the presence of one or more adjacent ions.

The following will describe an example of an ion trap mass spectrometer that can obtain mass spectra suitable for use with embodiments described herein for calculating corrected analyte masses. FIG. 1 illustrates a schematic view of an ion trap mass spectrometer 100 that includes an ionization source 105 configured to ionize molecules. The ions are then transported through an ion transfer tube 175, a skimmer 160, an ion guide 145, a first electrostatic lens 165, a first ion guide 150, a second electrostatic lens 170, an octupole ion guide 155, an ion trap mass analyzer 140, and to a detector 624. Examples of ionization sources configured to ionize molecules may include electrospray ionization, chemical ionization, thermal ionization, and matrix assisted laser desorption ionization sources. Ion transport tube 175 can be heated up to evaporate residual solvent and break up solvent-analyte clusters as ions move to the first intermediate chamber 120. In an embodiment, first ion guide 150 may be in the form of a quadrupole mass filter (QMF) capable of populating ion trap mass analyzer 140 with one or more ion species that have a particular m/z value. An embodiment of an ion trap mass analyzer is described in U.S. Pat. No. 5,420,425, which is hereby fully incorporated by reference herein. The detector may be configured to receive and measure the ionized molecules from the mass analyzer.

During ion transport, the ions move from the ion source chamber 110 to a series of intermediate chambers 120, 125, 130, and then to a vacuum chamber 135. Intermediate chambers 120, 125 and 130 and vacuum chamber 135 are evacuated by a suitable arrangement of pumps to maintain the pressures therein at the desired values. In one example, intermediate chamber 120 communicates with a port 180 of a mechanical pump, and intermediate chambers 125 and 130 and vacuum chamber 135 communicate with corresponding ports 185, 190 and 195 of a multistage, multiport turbomolecular pump.

Mass spectrometer 100 includes an electronic controller 618, a RF voltage source 616 configured to supply RF voltages to the ion guides and the ion trap, a DC voltage source 620 configured to supply one or more DC voltages to various components, and a data system 622 configured to acquire data from a detector and store the data to a memory portion. The electronic controller 618 is operably coupled to the various devices including the pumps, sensors, ionization sources, ion transfer tubes, electrostatic lenses, ion guides, collision cells, data systems, ion traps, and mass analyzers to control the devices and conditions at the various locations throughout the mass spectrometer 100, as well as to receive and send signals representing the ions being analyzed.

While the foregoing paragraphs describe an ion trap mass spectrometer, it should be understood that this description is provided by way of example only, and does not limit the invention to operation with a particular type of mass spectrometer. For example the mass correction methods described herein may be incorporated into a number of mass spectrometer types and architectures such as, for example, a triple quadrupole mass spectrometer where the last quadrupole is an ion trap, a Fourier transform ion cyclotron resonance spectrometer, or an Orbitrap mass spectrometer.

An aspect of mass spectrometry performance is dynamic range. The dynamic range refers to the working concentration range of ions that can be detected, while satisfying certain minimum requirements for spectral quality, such as signal to noise ratio and mass accuracy. Ion trap mass spectrometers (ITMS) typically have a relatively high sensitivity that allows the detection of single ion events. However, ITMS typically are limited in the ability to analyze a wide concentration range of analyte ions. The upper limit of ion concentrations that can be measured is limited by several effects. For instance, the dynamic range of the detection circuitry can impose an upper limit. However, this can be mitigated through the use of high dynamic range electron multipliers and analog-to-digital converters, and/or through the use of dual-stage amplifiers.

Another limitation to the dynamic range in ITMS is caused by ion-ion interactions. The effects of these interactions are such that the ions themselves contribute to an additional quadrupolar DC trapping potential which alters the ion motion, and can cause an offset in the observed mass-to-charge ratio of a particular analyte ion.

Equations 1a to 1d describe properties of an ion within a quadrupole ion trap. The motion of ions in the ITMS is periodic, and ions of different mass-to-charge ratios oscillate with different frequencies ω, as shown in Equation 1a, where β is the Mathieu stability parameter and Ω is the frequency of the applied trapping potential. The parameter βdepends on the dimensionless parameters $a_u$ and $q_u$, as shown in Equation 1b. Additionally, the parameters $q_u$ and $a_u$ are described by Equations 1c and 1d, respectively. In Equations 1b to 1d, the subscript u refers to either the x or y dimension. Referring back to Equation 1c, e is charge, V is the amplitude of the main quadrupolar AC trapping voltage, r is the field radius, and m is mass. Referring back to Equation 1d, U is the magnitude of the DC quadrupolar voltage.

$$\omega = \frac{\beta\Omega}{2} \quad \text{(Eq. 1a)}$$

$$\beta_u = \left(a_u + \frac{q_u^2}{2}\right)^{1/2} \quad \text{(Eq. 1b)}$$

$$q_u = \frac{4eV}{mr^2\Omega^2} \quad \text{(Eq. 1c)}$$

$$a_u = -\frac{8eU}{mr^2\Omega^2} \quad \text{(Eq. 1d)}$$

The mass-to-charge ratio dependence of the ion oscillation frequencies allows for various manipulations which depend on resonance to be carried out, including collisional induced dissociation (CID), waveform isolation, and most importantly mass analysis. Based on Equations 1a to 1d, an additional DC potential U will change the ion oscillation frequency ω. The frequency shift reduces the performance of the various frequency dependent manipulations to different degrees. In the case of mass analysis, the shift in frequency is observed as a shift in the ejection time for the ion, leading to an inaccurate mass assignment. As the magnitude of the ion-ion interactions becomes very large, the observed mass spectral peaks become degraded; the peaks become broader and less intense, significantly decreasing the quality of the spectrum. The point at which the spectrum degradation is no longer tolerable is referred to as the spectral space-charge limit. Typically the spectral space charge limit is set well below the point of peak degradation, to some arbitrary value of mass shift, such as 0.1 Da. By setting such a limit, however, the dynamic range of the instrument is sacrificed for mass accuracy, even though substantial capacity can be available before the onset of peak degradation.

The effective potential induced by a group of analyte ions of the same mass-to-charge ratio can be referred to as self space charge. Here, analyte ion refers to the targeted ion for which the mass is being measured. It should be noted that each ion or peak in a mass spectrum can be designated as an analyte ion with respect to an iteration of the mass correction method. Thus, the mass correction method would be performed several times where the mass correction method is applied to each peak when it designated as an analyte ion. Alternatively, the effective potential induced by a group of ions other than the analyte ions can be referred to as adjacent ion space charge. A distinction can be made between these two types of interactions, self and adjacent, because typically the magnitude of the latter is much greater than that of the former. Where there are a group of ion particles in a volume, Equation 2 can describe the potential u(r) at point r={x,y,z}, where $\epsilon_0$ is the permittivity of free space, $N_p$ is the total number of particles, $q_p$ is the charge of particle p, and $r_p$ is the location of particle p. As the distance between the particles and the point grows, the denominator increases and the potential u(r) decreases.

$$u(r) = \frac{1}{4\pi\varepsilon_0}\sum_{p=1}^{N_p}\frac{q_p}{|r - r_p|} \quad \text{(Eq. 2)}$$

Figure 2:
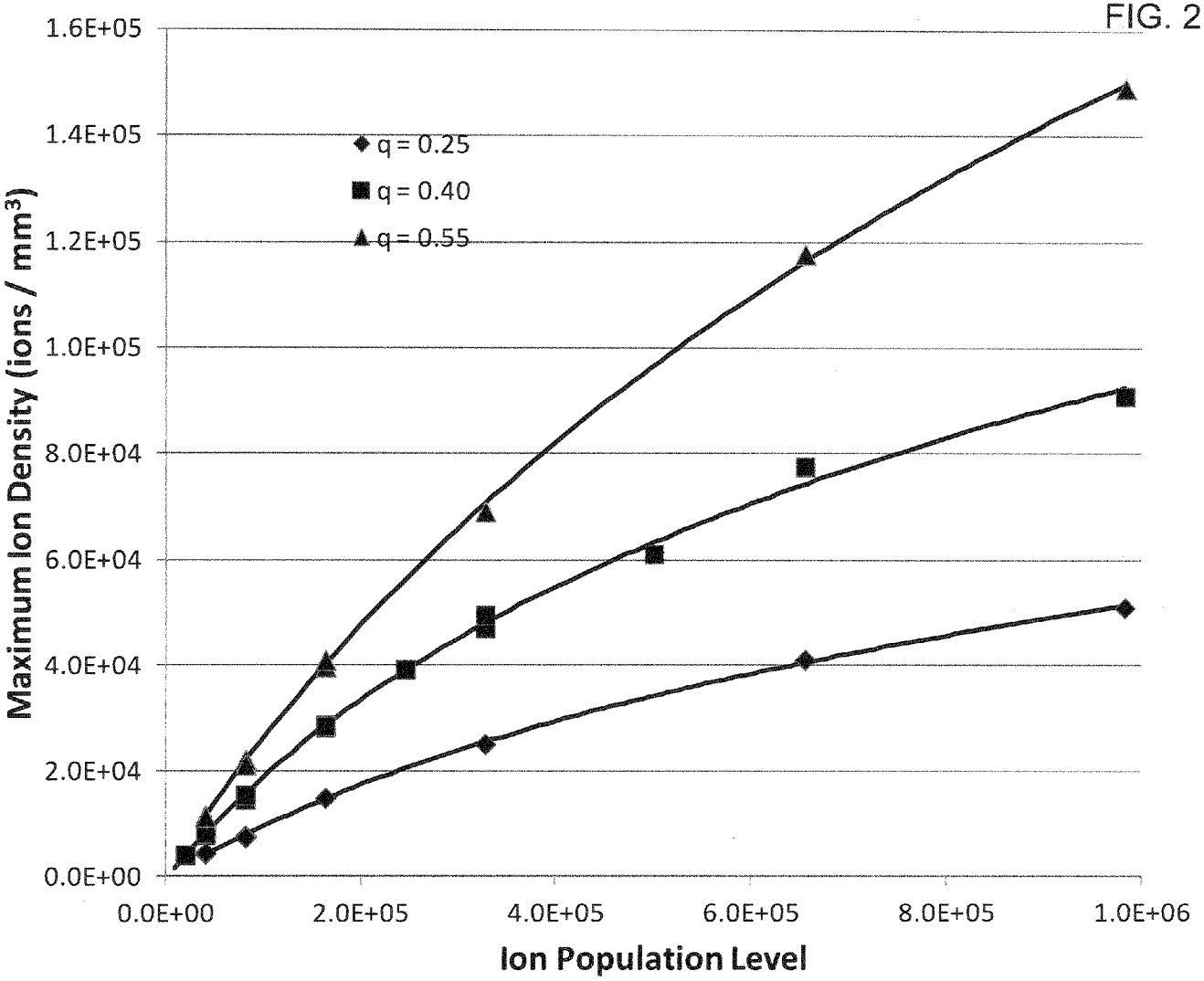
FIG. 2 is a graph illustrating maximum ion densities for an ion having a m/z of 202 as a function of the ion population at different Mathieu q values.

The density of ions in ITMS depends on a number of factors, including the trapping potential, the nature and pressure of any neutral gas particles, and the ion-ion interactions themselves. This is apparent from numerical simulations of ion motion in a linear ITMS with the ion-ion interactions modeled using Equation 2. FIG. 2 is a plot of maximum ion density as a function of the ion population for various values of the Mathieu q parameter. The density increases linearly for relatively small numbers of ions, and then starts to plateau as the magnitude of the ion-ion interactions begins to compete with the magnitude of the trapping pseudo-potential. Increasing the main trapping voltage amplitude has a marked effect on the storage capacity of the trap. The spectral space charge limit of a typical linear ITMS is on the order of $10^4$ ions, which is within the linear range, as illustrated in FIG. 2.

Figure 3:
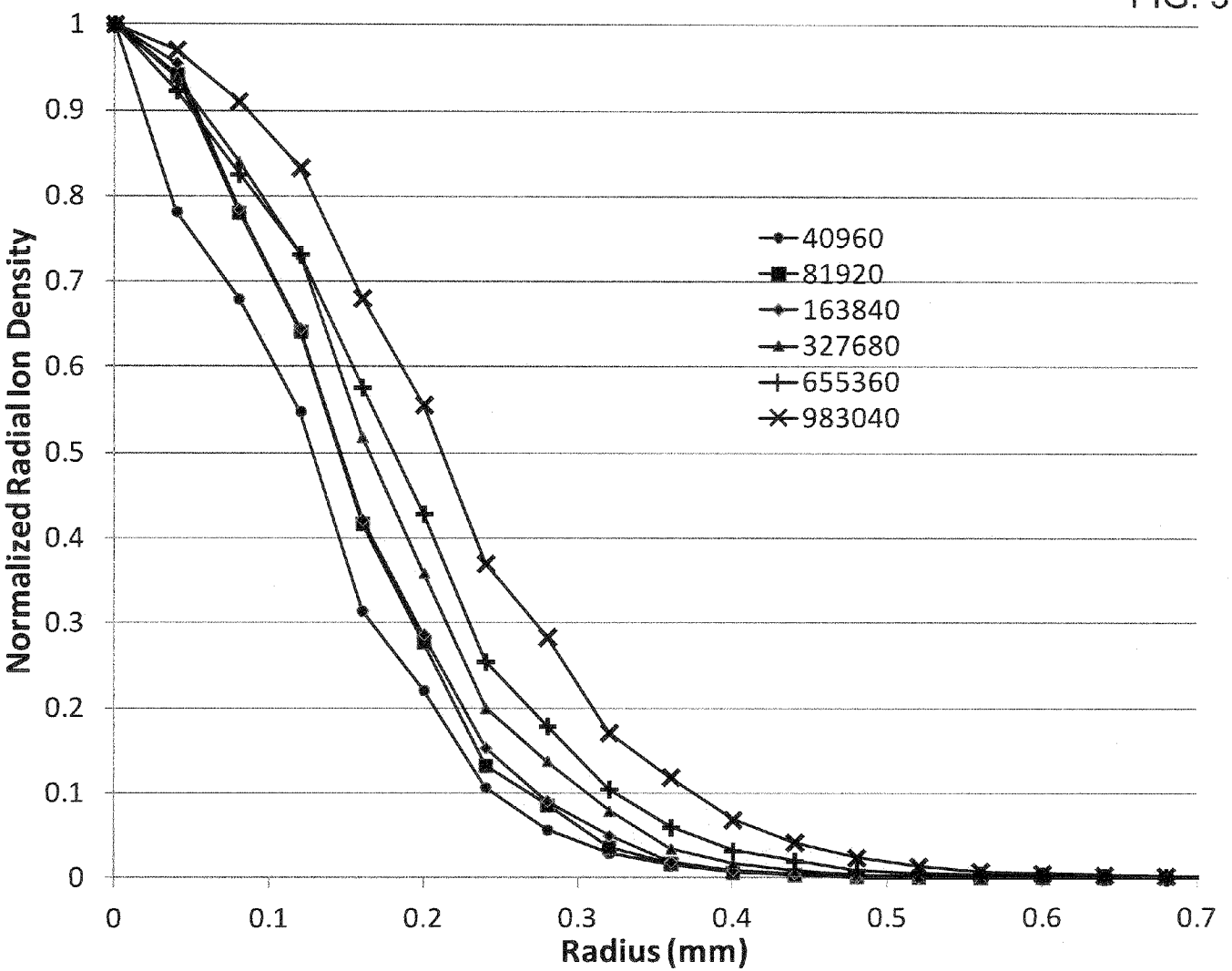
FIG. 3 is a graph illustrating normalized ion densities for an ion having a m/z of 202 as a function of radius for different ion populations.

FIG. 3 shows simulation results of the radial ion density distributions as a function of the ion distribution radius for different ion populations at a given q value. For the simulation shown in FIG. 3, the analyte ion has a m/z of 202 and was simulated with ion populations of 40,960 (circles); 81,920 (squares); 163,840 (diamonds); 327,680 (triangles); 655,360 (plus signs); and 983,040 (x signs). The half-maximum widths of the ion distributions increase linearly with the number of ions, demonstrating that the repulsive ion-ion forces are large enough to expand the ion distribution.

Figure 4:
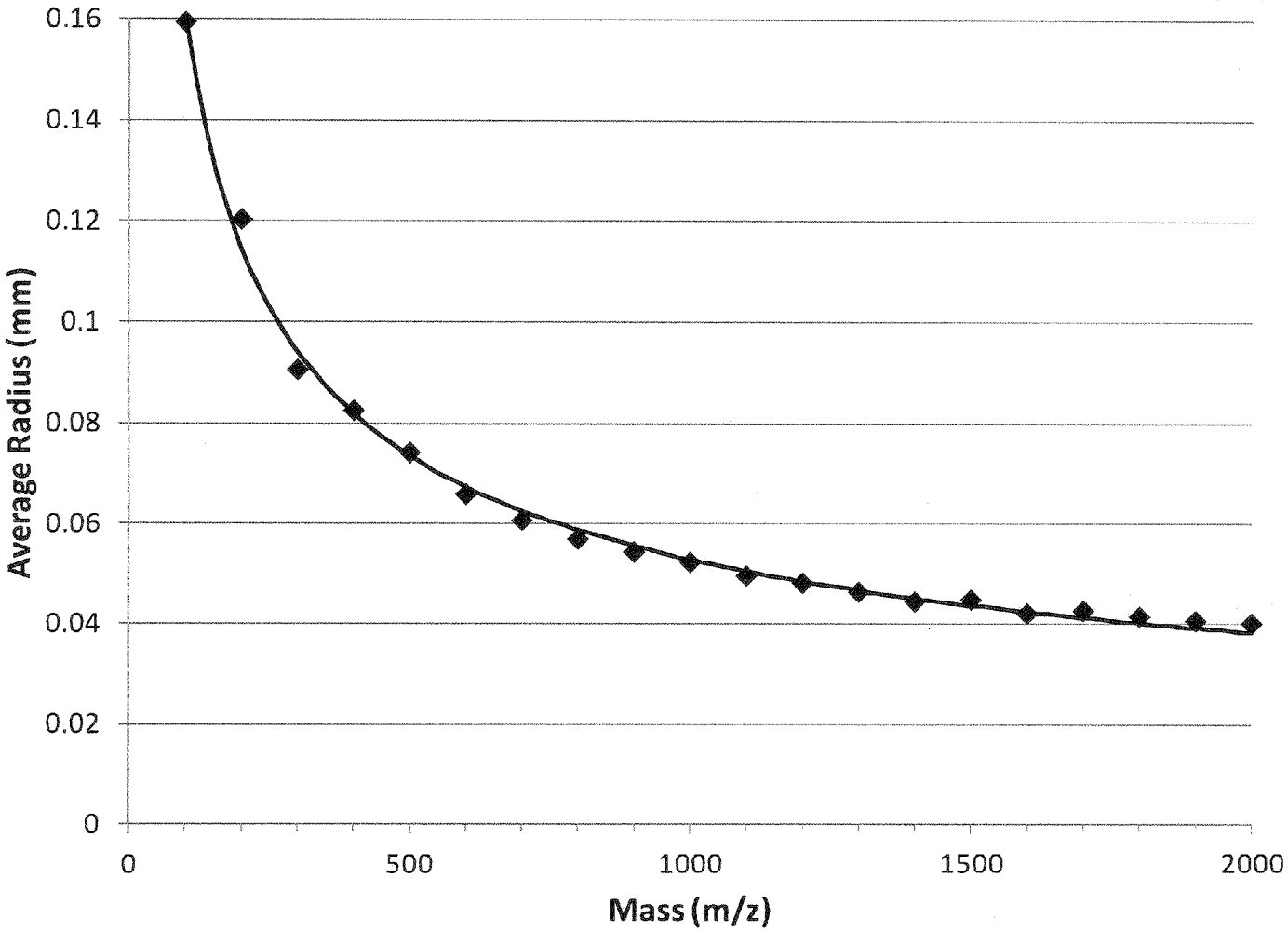
FIG. 4 is a graph illustrating simulated average radius values for ions trapped in a linear ion trap as a function of the mass-to-charge ratio.

The ion density and thus the magnitude of ion-ion interactions forces are expected to vary with mass. For a given value of the Mathieu q parameter, the size of the ion distribution varies as the inverse square-root of mass, as is predicted from theory (see Marshall et al., Journal of American Society for Mass Spectrometry, 9, (1998), pp. 473-481) and demonstrated by numerical simulation results, as shown in FIG. 4. This effect is due to the linear mass dependence of the trapping force at a constant q value, which compresses the higher mass ions more than the lower mass ions. This leads to a larger ion-ion interaction force for high mass ions, and correspondingly larger observed mass spectral shifts caused by the self space-charge.

The following will describe a method of correcting for space-charge induced mass shifts in ion traps. Mass shifts can be induced on an ion of interest (i.e., analyte) both by ions of the same mass-to-charge ratio, as well as by ions having an adjacent mass-to-charge ratio. This method includes a calibration process so that subsequent analysis can be performed on an arbitrarily complex spectrum. Because the correction method described herein will improve measured mass-to-charge ratio accuracy at relatively high ion concentrations, the ion fill times can be substantially increased resulting in an improved ion trap dynamic range. This contrasts with mass spectrometry measurements that limit the concentration of ions based on maintaining a certain level of mass accuracy. It should be noted that the space charge correction method described herein is not limited to a particular sample and can correct the peak position for a wide variety of arbitrary and complex spectra.

Figure 5:
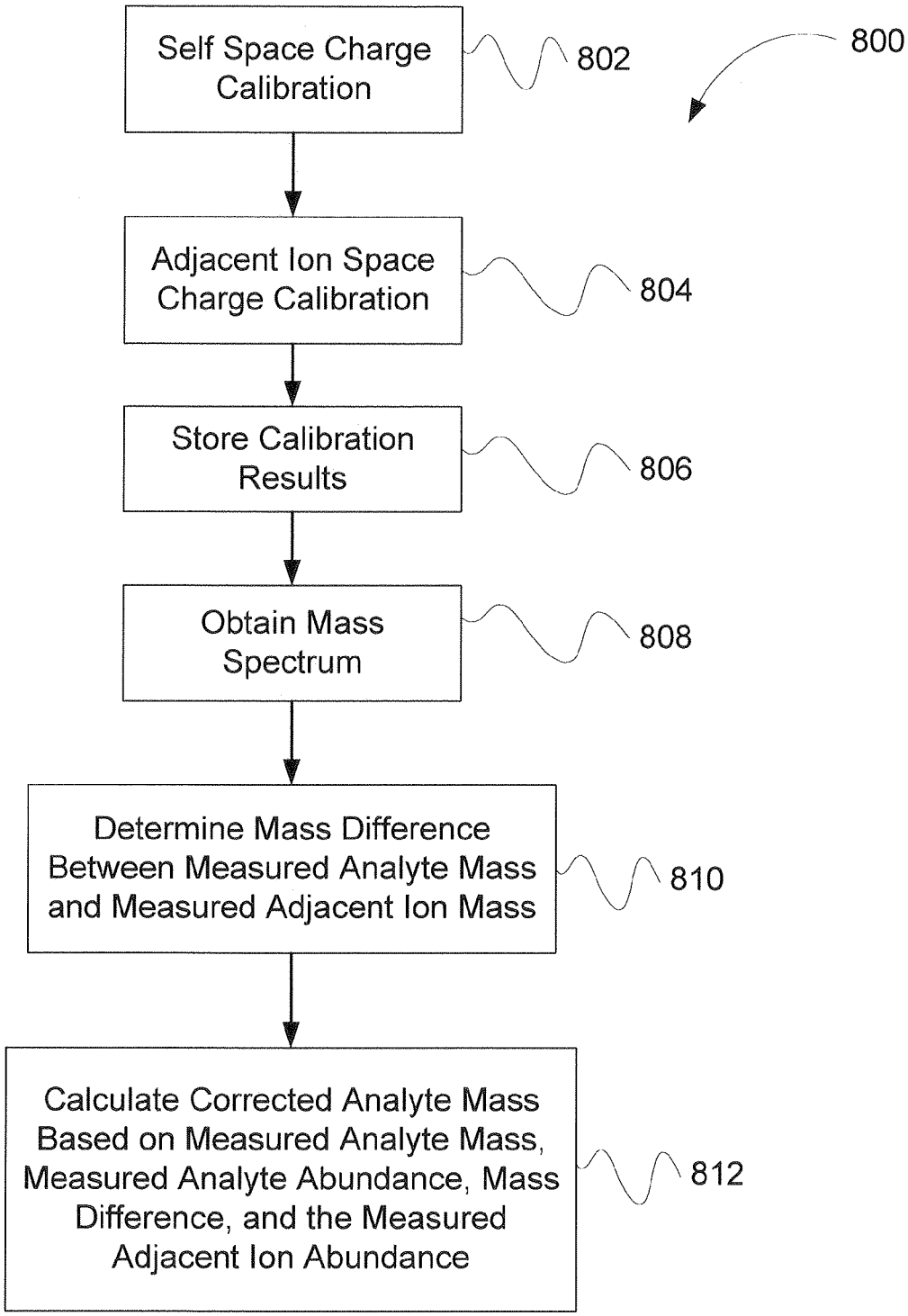
FIG. 5 is a flow chart illustrating a method of determining a mass of an analyte that includes a mass correction that accounts for space charge effects.

FIG. 5 is a flow chart that illustrates a method 800 that accounts for mass shifts induced by ions of the same mass-to-charge ratio and also for adjacent ions. It should be noted that method 800 can be applied to any arbitrarily complex spectrum that has ions at mass positions and abundances that are not known a priori. Ion abundance is a value that represents the number or concentration of a particular ion in an ion trap. The ion abundance may also be referred to as an intensity value, which is proportional to a current measured at a detector (e.g., detector 624 of FIG. 1). The mass-to-charge ratio of an ion may be referred to as m/z or simply as a "mass" where it is assumed that the charge is unity. In addition, the mass-to-charge ratio value of an ion may be referred to as a mass spectral position that is the position of a peak on a mass spectrum. It should be noted that other equivalent parameters can be used for the mass-to-charge ratio that correspond to the m/z values such as, for example, a frequency value and an ejection time for the ion of interest. The mass correction methods described herein are not limited to a group of ions having only a single charge level (i.e., z=1) and can be applied to a group of ions having a one or more charge levels (i.e., z=1, 2, 3, etc.).

Method 800 includes a self space-charge calibration step 802, an adjacent ion space-charge calibration step 804, a store calibration results step 806, an obtain mass spectrum data step 808 step, a determine mass difference step 810, and a calculate corrected analyte mass step 812. The following will describe the steps of method 800 in more detail.

The self space charge calibration step 802 includes determining a set of constants that can be implemented on a self charge space correction. In an embodiment, the self charge space correction can be based on the measured analyte mass-to-charge ratio and the measured analyte abundance. The term measured can be used to describe a scenario where the parameter was measured with a mass spectrometer. Equation 3 shows a mathematical representation of the self charge space correction, $$\text{Self Charge Space Correction}=S(M_0)\times I[M_o] \quad \text{(Eq. 3)}$$

where $S(M_0)$ is a self charge space factor and $I[M_o]$ is the measured analyte abundance at the measured analyte mass-to-charge ratio $M_0$. The Self charge Space Correction in Equation 3 outputs an offset in the units of a mass-to-charge ratio value.

The self charge space factor $S(M_0)$ is a function of the measured analyte mass-to-charge ratio $M_0$, which is represented by Equation 4, $$S(M_0) = a + b\ \exp\left(\frac{M_0}{c}\right) \quad \text{(Eq. 4)}$$

where a, b, and c are constants. In order to calculate the constants a, b, and c for calibrating the self charge space factor $S(M_0)$, the mass spectral position of isolated analyte ions is monitored as a function of the ion abundance. In other words, the mass-to-charge ratio and ion abundance of the analyte is measured for an ion trap that has various concentrations of analyte ions in the absence of adjacent ions. In an embodiment for the self space charge calibration, at least a first and second analyte mass-to-charge ratio can be measured at a respective first and second analyte concentration. In addition, a first and second analyte abundance can be measured at the respective first and second analyte concentration. Self space charge calibration can be performed in an ion trap having a predetermined damping pressure. In another embodiment, multiple self space charge calibrations can be performed at a variety of predetermined damping pressures. It should be noted that the self space charge calibration can be applied to mass spectra data that are obtained with about the same damping pressure because space charge effects can depend on damping pressure. Although Equation 4 describes an exponential model for calibrating the self charge space factor, other models may be applied such as a linear or constant model.

In an embodiment, a reference analyte mass-to-charge ratio can be subtracted from the measured first and second analyte mass-to-charge ratio to determine the respective mass error or mass shift due to self space charge effects. The reference analyte mass-to-charge ratio may be known where the analyte has already been well characterized or is a known reference sample. Alternatively, a reference analyte mass-to-charge ratio value can be determined where the analyte is measured at a relatively low ion concentration so that the ion-ion interactions are low.

Equation 3 exhibits a linear dependence of the Self Space Charge Correction function on the concentration of analyte ions. The slope can be calculated using regression analysis on the calculated mass errors and measured ion abundance values. An aspect of regression analysis can include least squares analysis. The calculated slope can be approximately equal to $S(M_0)$. In an embodiment, the self space charge calibration step 802 can be performed several times for various analyte ions having mass-to-charge ratio values that span the range of interest. Next, the calculated slopes, determined for a set of analytes ions, can then be used for determining the constants a, b, and c of Equation 4.

The adjacent ion space charge calibration step 804 includes determining a set of constants that can be implemented on an adjacent ion space charge correction. An adjacent ion is an ion that has a mass-to-charge ratio that is different than the mass-to-charge ratio of the analyte. During a mass spectrometry measurement, there can be more than one or more species of adjacent ions where the charged particles have the same or similar mass-to-charge ratios so long as they are different than the mass-to-charge ratio of the analyte. In an embodiment, the adjacent ion space charge correction can be based on a mass-to-charge ratio difference and the measured adjacent ion abundance. The mass-to-charge ratio difference can be a difference between the measured adjacent ion mass-to-charge ratio and the measured analyte mass-to-charge ratio. It should be noted that other equivalent parameters can be used for the mass-to-charge ratio difference such as, for example, a m/z difference, a difference in spacing between spectral peaks, a difference in frequency values that correspond to the m/z values, and a difference in ejection times for the ions of interest. Equation 5 shows a mathematical representation of the self charge space correction, $$\text{Adjacent Ion Space Charge Correction}= A(M_i-M_0)\times I[M_i] \quad \text{(Eq. 5)}$$

where $A(M_i-M_0)$ is an adjacent ion space charge factor and $I[M_i]$ is the measured adjacent ion abundance at the measured adjacent ion mass-to-charge ratio $M_i$. The mass-to-charge ratio difference can be represented by the expression $M_i-M_0$. The Adjacent Ion Space Charge Correction in Equation 5 outputs an offset in the units of a mass-to-charge ratio value.

The adjacent ion space charge factor $A(M_i-M_0)$ is a function of the mass-to-charge ratio difference $M_i-M_0$ and the analyte ion mass-to-charge ratio $M_0$, which is represented by Equation 6, $$A(M_i - M_0) = d(M_0) - f(M_0)\exp\left(\frac{M_i - M_0}{g(M_0)}\right) \quad \text{(Eq. 6)}$$

where $d(M_0)$, $f(M_0)$, and $g(M_0)$ are constants for a particular analyte ion mass-to-charge ratio $M_0$. In another embodiment, the adjacent ion space charge factor $A(M_i-M_0)$ is a function of the mass-to-charge ratio difference $M_i-M_0$ where the terms $d(M_0)$, $f(M_0)$, and $g(M_0)$ can be simplified to constants d, f, and g so that they do not depend on the measured adjacent ion mass-to-charge ratio.

In order to calculate the constants $d(M_0)$, $f(M_0)$, and $g(M_0)$ for calibrating the adjacent ion space charge factor $A(M_i-M_0)$, the mass spectral position of the analyte ions is monitored in the presence of various adjacent ion concentrations. In other words, the mass-to-charge ratio of the analyte and the ion abundance of the adjacent ion are measured for an ion trap that has a nominal analyte concentration and various concentrations of adjacent ions.

In an embodiment for calibration, at least a first and second analyte mass spectral position can be measured at a nominal analyte ion concentration containing a respective first and second adjacent ion concentration. In addition, a first and second adjacent ion abundance can be measured at the nominal analyte ion concentration containing the respective first and second adjacent ion concentration. The nominal analyte ion concentration may be chosen to be a typical or most likely ion concentration. The parameters of Eq. 6 do not depend strongly on the analyte concentration over a typical analyte concentration range. However, a procedure for determining these parameters as a function of analyte concentration would constitute a simple extension to this method, whereby the adjacent ion space charge calibration step 804 was repeated for at least a first and second analyte ion concentration.

Adjacent ion space charge calibration can be performed in an ion trap having a predetermined damping pressure. In another embodiment, multiple adjacent ion space charge calibrations can be performed at a variety of predetermined damping pressures. It should be noted that the adjacent ion space charge calibration can be combined with self space charge calibration when they were both performed at about the same damping pressure. In addition, the adjacent ion space charge calibration and self space charge calibration can be applied to mass spectra data that is obtained with about the same damping pressure for both types of calibrations.

The process for populating an ion trap for the adjacent ion calibration can include using a first set fill time for introducing analyte ions at the nominal concentration. A second variable fill time can be used for introducing adjacent ions into the ion trap already containing the nominal analyte ions. The variable fill time can be independent of the first set fill time for the analyte. In this process, the first set fill time is held constant while the second variable fill time is varied independently over a range of interest such as, for example, from about $1\times10^2$ ions to about $3\times10^4$ ions.

In an embodiment, only one analyte and one adjacent ion mass-to-charge ratio should be isolated in the ion trap. This process for populating an ion trap for the adjacent ion calibration can be performed with a mass spectrometer that includes an isolation stage that is separated in space from the ion trap such as, for example, a quadrupole mass filter (QMF) that is located in front of the ITMS. The QMF is set to pass first one species for an indicated amount of time, and then the other species for another amount of time. Spectra are acquired over a range of different fill times for the adjacent ion, and a relationship between the ejection time of the analyte and the abundance of the adjacent ion is determined.

In another embodiment for performing the adjacent ion calibration, a multi-frequency isolation waveform can be used to populate the ion trap with two or more species of ions. The use of the isolation waveform allows the calibration process to be performed without a QMF. Because a QMF can be a relatively expensive component in a mass spectrometer, performing a calibration process with the isolation waveform can allow the process to be performed on a simpler and less expensive instrument. An isolation waveform can be applied to the ion trap as the ions are being injected into the trap. The isolation waveform can have a notch that allows a particular ion species to populate the trap. The isolation waveform causes ions that do not have the desired m/z value to be ejected from the trap. In an embodiment, a first isolation waveform can be applied to the trap for a first time period during the ion injection process so that the analyte ion populates the trap. Next, a second isolation waveform can be applied for a second time period so that the analyte ion and the adjacent ion populate the trap at the same time. Thus, the use of isolation waveforms allows the adjacent ion calibration to be performed on a relatively simple ion trap that does not require an upstream QMF.

In yet another embodiment for performing the adjacent ion calibration, an ion storage device can be used to help populate the ion trap with two or more species of ions. An ion storage device is configured to store ions and can transfer ions to and from an ion trap mass analyzer. In general, an ion storage device is less expensive than a QMF because it has less stringent fabrication tolerances, simpler electronics and is not configured to measure mass-to-charge ratios in an accurate manner. The use of the ion storage device allows the calibration process to be performed without a QMF. Because a QMF can be a relatively expensive component, performing a calibration process with an ion trap mass analyzer and an ion storage device can allow the process to be performed on a simpler and less expensive instrument.

Figure 6:
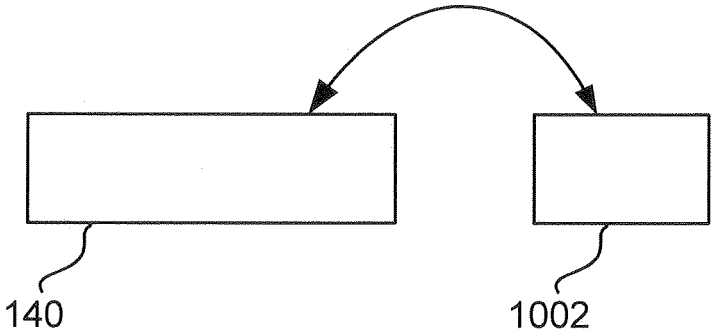
FIG. 6 illustrates a simplified schematic of an ion trap mass analyzer and an ion storage device.

FIG. 6 illustrates a schematic of an ion trap mass analyzer 140 and an ion storage device 1002. This method includes populating the ion trap mass analyzer 140 for a first fill time with ions having a range of m/z values. Next, the analyte ion is isolated in ion trap mass analyzer 140 by applying the appropriate isolation waveform. Once the analyte ion is isolated in the ion trap mass analyzer 140, it can be transferred to the ion storage device 1002. Ion trap mass analyzer 140, which is now empty, can now be populated again for a second fill time with ions having a range of m/z values. Next, the adjacent ion species can be isolated in ion trap mass analyzer 140 by applying the appropriate isolation waveform. Once the adjacent ion is isolated in ion trap mass analyzer, the analyte ion can be transferred from the ion storage device 1002 back to the ion trap mass analyzer 140. Thus, the use of an ion storage device allows the adjacent ion calibration to be performed on a relatively simple instrument that does not require an upstream QMF.

In another embodiment, theoretical self space charge and adjacent ion interactions can be calculated using a simulation method to determine a, b, c of Eq. 4 and $d(M_0)$, $f(M_0)$, and $g(M_0)$ of Eq. 6 for a particular set of analyte ion mass-to-charge ratios $M_0$. The simulation would reproduce the essential elements of the above described procedures for mass analysis in a ITMS: analyte ejection times (m/z positions) would be measured for different concentrations of analyte ions to determine the self space charge coefficients, and analyte ejection times would be measured for a nominal concentration of analyte ions in the presence of varying numbers of adjacent ions to determine the adjacent space charge coefficients. There are many suitable numerical methods for calculating ion trajectories in ITMS; in general, the ion positions and velocities are advanced by integrating Newton's equations of motion, where acceleration due to the time-dependent trapping electric fields is calculated at certain time intervals. Typically, these simulations will include random changes in ion velocity due to collisions with neutral gas species. The simulation would also necessarily include ion-ion interaction forces in the calculation of the acceleration.

Equation 5 exhibits a linear dependence of the Adjacent Ion Space Charge Correction function on the concentration of adjacent ions. The slope can be calculated using regression analysis on the calculated mass errors and measured ion abundance values. The calculated slope can be approximately equal to $A(M_i-M_0)$. Next, the calculated slope can then be used for determining the constants $d(M_0)$, $f(M_0)$, and $g(M_0)$ at a particular analyte ion mass-to-charge ratio $M_0$ for Equation 6. In an embodiment, the adjacent ion space charge calibration step 804 can be performed several times for various analyte ions having mass-to-charge ratio values that span the range of interest.

Figure 7:
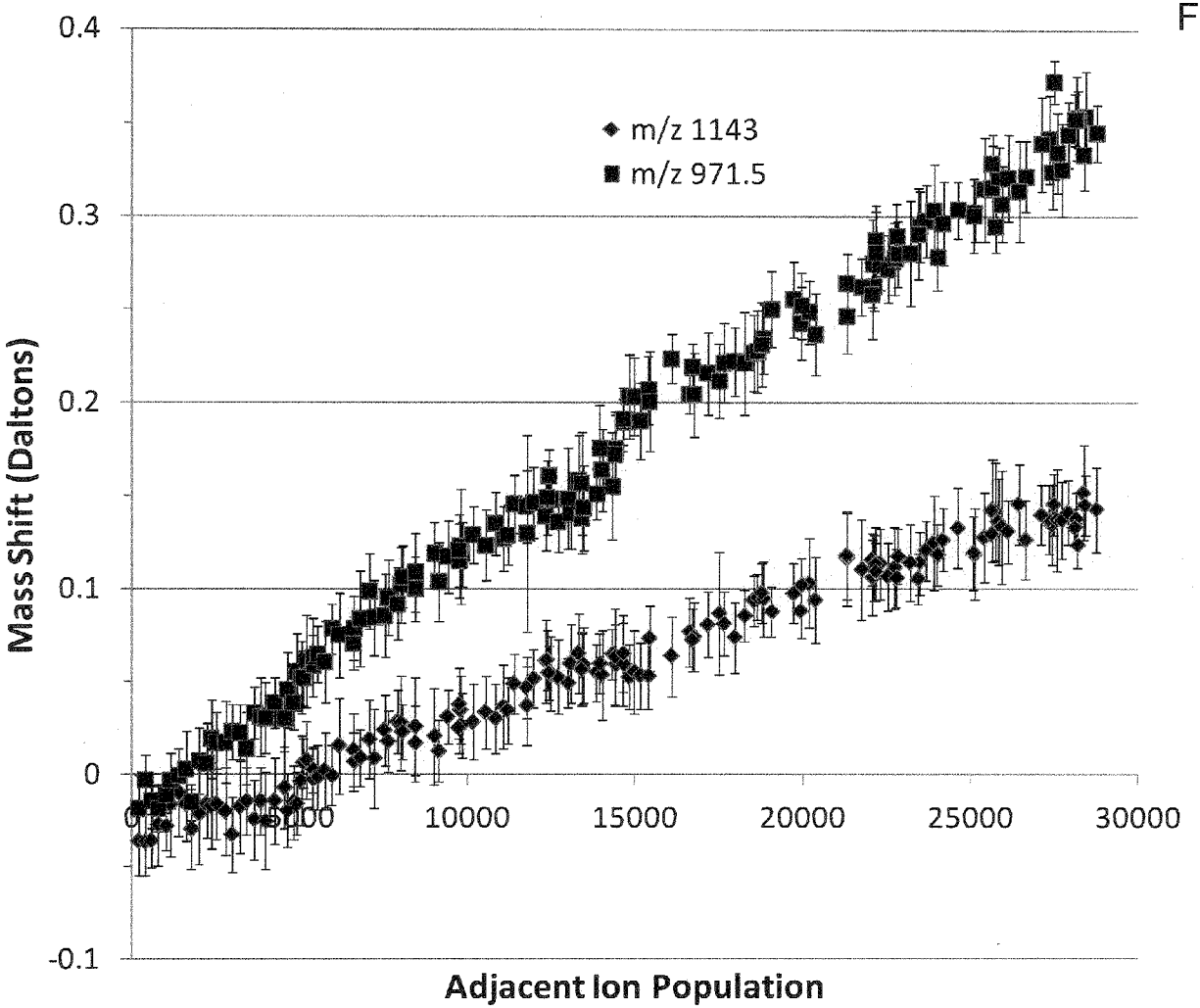
FIG. 7 is a graph illustrating the mass shifts of analyte ions having a m/z of 965.5 as a function of a particular adjacent ion abundance such as m/z 971.5 (squares) and m/z 1143 (diamonds)

FIG. 7 is a graph illustrating the results of an adjacent ion space charge calibration step 804 for an analyte having a m/z of 969. The graph shows the mass shift of the analyte ion on the Y-axis as a function of the adjacent ion population. Note that the error bars represent one standard deviation. In particular, the graph shows the mass shifts individually caused by an adjacent ion having a m/z of 971.5 (squares) or a different adjacent ion having a m/z of 1143 (diamonds). For the graph in FIG. 7, the analyte mass shift was measured in the presence of only one adjacent ion having a particular m/z.

Referring to FIG. 7, the mass shift is a difference between the measured analyte mass-to-charge ratio and a reference analyte mass-to-charge ratio. It should be noted that the absolute magnitude of the mass shift is much larger for the adjacent ion with a m/z of 971 than the other adjacent ion with a m/z of 1143. This effect is ascribed to the fact that the absolute mass difference between m/z 971 and m/z 969 is less that the absolute mass difference between m/z 1143 and m/z 971. Although FIG. 7 shows the individual effect of two adjacent ions, several additional adjacent ions having a range of m/z values could be individually calibrated for the analyte of interest.

Figure 8:
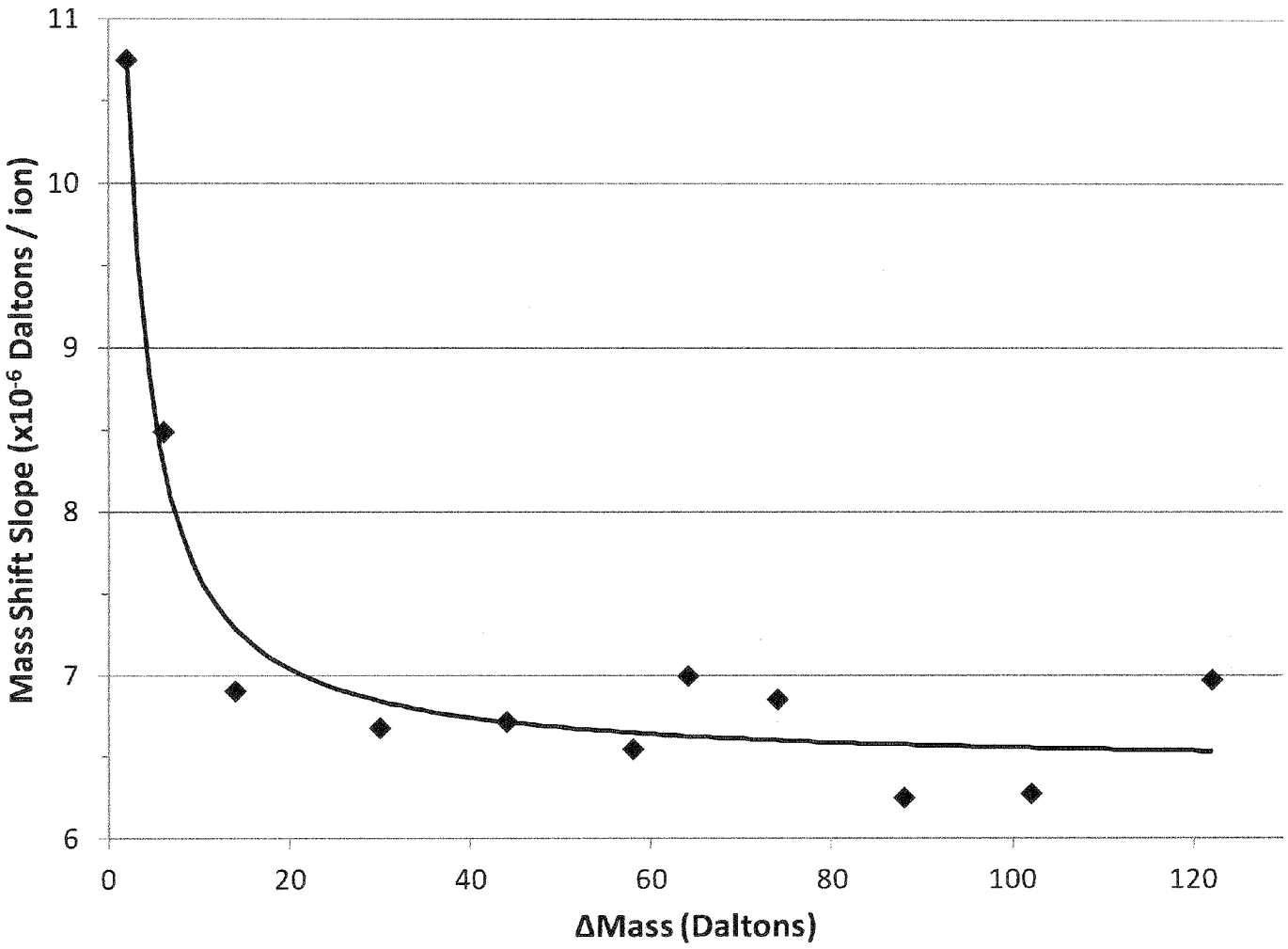
FIG. 8 is a graph illustrating the mass shift slope for an analyte as a function of a difference between the adjacent ion mass and the analyte mass.

For each adjacent ion calibration shown in FIG. 7, a mass shift slope can be calculated in units of Daltons per number of adjacent ions in the trap. In FIG. 8, the calculated slopes are plotted as a function of the mass difference $M_i-M_0$. In general, the mass shift slope exhibits an exponential decay with increasing mass difference. The parameters $d(M_0)$, $f(M_0)$, and $g(M_0)$ for a particular analyte ion mass-to-charge ratio $M_0$ can be derived for Equation 6 using regression analysis of the exponential decay in FIG. 8. The adjacent ions that are very close in mass to the analyte have a much larger effect on the ejection time of the analyte than ions that are further away in mass. In an embodiment, adjacent ions that are lower in mass-to-charge ratio than the analyte do not appreciably affect the ejection time of the analyte. This is because typically the resonance ejection method of mass analysis in the ITMS uses a forward scan of the main RF amplitude, such that at the time of ejection, the ion trap only contains adjacent ions at higher mass-to-charge ratio values.

After the self space charge calibration step 802 and the adjacent ion space charge calibration 804 are performed, a store calibration result step 806 can be performed. For example, the parameters a, b, c, as determined from one or more analytes of interest can be stored to a memory device that is accessible by a microprocessor. In addition, the parameters $d(M_0)$, $f(M_0)$, and $g(M_0)$ for a range of adjacent ions of interest can also be stored to a memory device that is accessible by a microprocessor or electronic controller. Such stored parameters can be used in a subsequent calculation step for determining a corrected analyte mass-to-charge ratio value.

It should be noted that the calibrations steps 802 and 804 are performed before measuring the mass spectrum with the calibrated mass spectrometer. In an embodiment, the calibrations steps 802 and 804 can be performed for a particular mass spectrometer that is used to obtain mass spectra to account for instrument-to-instrument variability. The calibration steps 802 and 804 may be performed once and applied to numerous mass spectra obtained with the same calibrated mass spectrometer. However, under certain circumstances where increased accuracy is required, the mass spectrometer can be re-calibrated at a particular recurring frequency interval to account for potential instrument drift.

Method 800 also includes obtaining a mass spectrum step 808 using a mass spectrometer that has been calibrated with the self space charge calibration 802 and the adjacent ion space charge calibration 804. The mass spectrum includes one or more mass-to-charge ratio values with each mass-to-charge ratio value having a corresponding ion abundance value. The mass spectrum can be stored on a memory device that is accessible by a microprocessor. The mass spectrum is obtained using a particular machine such as, for example, a mass spectrometer. An analyte is analyzed using a mass spectrometer that physically transforms the analyte into an ionized state. The measured mass-to-charge ratio value of the analyte represents a physical property of a tangible chemical in a sample.

Once the mass spectrum has been obtained in step 808, a mass difference can be determined between the measured analyte mass-to-charge ratio and the measured adjacent ion mass in step 810. Next, a corrected analyte mass can be calculated based on the measured analyte mass-to-charge ratio, the measured analyte abundance, the mass-to-charge ratio difference, and the measured adjacent ion abundance, as shown in step 812.

Equation 7 represents an equation to calculate a corrected analyte mass-to-charge ratio, $$M_{corrected}(M_0)=M_0-\Delta m(M_0) \quad \text{(Eq. 7)}$$

where $M_0$ is a measured analyte mass-to-chare and $\Delta m$ is a mass correction offset. The mass correction offset is a summing together of the Self Charge Space Correction of Equation 3 and the Adjacent Ion Correction based on Equation 5, as shown in Equation 8.

$$\Delta m(M_0) = S(M_0)\cdot I[M_0] + \sum_{M_i=M_0+0.5}^{Last\ Mass} A(M_i - M_0)\cdot I[M_i]. \quad \text{(Eq. 8)}$$

Referring back to Equations 3 and 4, the Self Charge Space Correction term of Equation 8 is determined by multiplying the self charge space factor $S(M_0)$ times the measured analyte abundance $I[M_0]$ that results in a product having units of m/z. The self charge space factor $S(M_0)$ was described earlier in Equation 4. The vector $I[M_i]$ is an ordered list of ion abundances at measured mass-to-charge ratio values.

The Adjacent Ion Correction term in Equation 8 differs from the one in Equation 5 in that it is adapted to sum together the adjacent ion effect for adjacent ion populations having more than one m/z value. An adjacent ion correction factor $A(M_i-M_0)$ is multiplied by an ion abundance value $I[M_0]$ for mass-to-charge ratio values $M_i$. The term $M_i$ is incremented until $M_i$ is equal to the LastMass. The product values are then summed together to form the Adjacent Ion Correction in units of m/z. The term LastMass can represent the upper limit mass-to-charge ratio value of the range of interest or the upper limit mass-to-charge ratio value of the obtained mass spectrum. Referring back to the summation term in Equation 8, the Adjacent Ion Correction term is based on one or more mass-to-charge ratio difference values (i.e., $M_i-M_0$) and one or more measured adjacent ion abundance values (i.e., $I[M_i]$).

In an effort to reduce computational expense, the Adjacent Ion Correction can limit the amount of calculations by increasing the step size of the summation term in Equation 8. For example, $(M-M_0)$ may refer to the average mass difference for a range of masses, and $I[M_i]$ to the integrated intensity over said range of masses. In addition, adjacent ions that have an intensity that is not above a certain threshold can be removed from the calculation for the Adjacent Ion Correction. However, it is preferable to include the contributions from all ions with m/z greater than the analyte, because the aggregate affect of even low intensity adjacent ions can be significant.

The corrected m/z value that is calculated using Equations 7 and 8 can be stored in a memory that is either in a mass spectrometer or a computer. In addition, the corrected m/z value is a data transformation that can be visually depicted as a physical representation of a chemical on a display, where the display is either on a mass spectrometer or a computer display.

Although the mass correction methods described herein using Equation 7 have been applied using ITMS, a similar methodology may also be employed using Fourier transform ion cyclotron resonance and Orbitrap technology. These instruments also perform mass analysis by differentiating ions on the basis of oscillation frequency, and like-wise the observed mass positions are influenced by the effects of self space-charge and adjacent ion space-charge. In contrast to ITMS, the adjacent ion effects would need to be considered for ions of low as well as high mass-to-charge ratio, since these techniques analyze the entire range of mass-to-charge ratio simultaneously.

Under certain circumstances, self space charge correction can be relatively small. Depending on the measurement process, a user may know that a particular test will have a relatively low number of one or more analyte ions and that the predominant space charge effect will be due to the adjacent ion space charge effect. In such a case, Equation 8 can be simplified so that the Self Charge Correction term can be ignored making the mass correction method mathematically simpler. This method includes obtaining a mass spectrum, where the mass-to-charge ratio of the analyte was measured in a presence of a first adjacent ion. The mass spectrum includes a measured analyte mass-to-charge ratio, a measured first adjacent ion mass-to-charge ratio, and a measured first adjacent ion abundance. A corrected analyte mass-to-charge ratio can be calculated based on the measured analyte mass-to-charge ratio, the first mass-to-charge ratio difference, and the measured first adjacent ion abundance.

In an embodiment, the mass correction method described herein can be applied to other frequency dependent ion manipulations such as, for example, ion isolation and activation. Thus, instead of correcting for the mass accuracy of a mass spectrum, a frequency adjustment may be applied before performing the step of ion isolation or activation. The frequency adjustment would be based on a previous, yet recent measurement of ion concentration as a function of m/z, for example from the previous mass spectrum. As an example, Equation 9 could be used to apply a frequency adjustment for ion isolation or activation. Here, $F_c(M_0)$ is the corrected frequency of analyte ion $M_0$, $F_0$ is the nominal analyte frequency, $S(M_0)$ is a self space charge frequency adjustment slope in units of frequency per ion, $I[M_0]$ the abundance of the analyte ion, and the summation term is an adjacent ion frequency adjustment over all adjacent ions $M_i$. The term $A(M_i-M_0)$ is an adjacent ion space charge frequency adjustment slope in units of frequency per ion, and $I[M_i]$ is the abundance of adjacent ion $M_i$.

$$F_c(M_0) = F_0 + S(M_0)\cdot I[M_0] + \sum_{M_i} A(M_i - M_0)\cdot I[M_i] \qquad \text{(Eq. 9)}$$

Example 1

Figure 9:
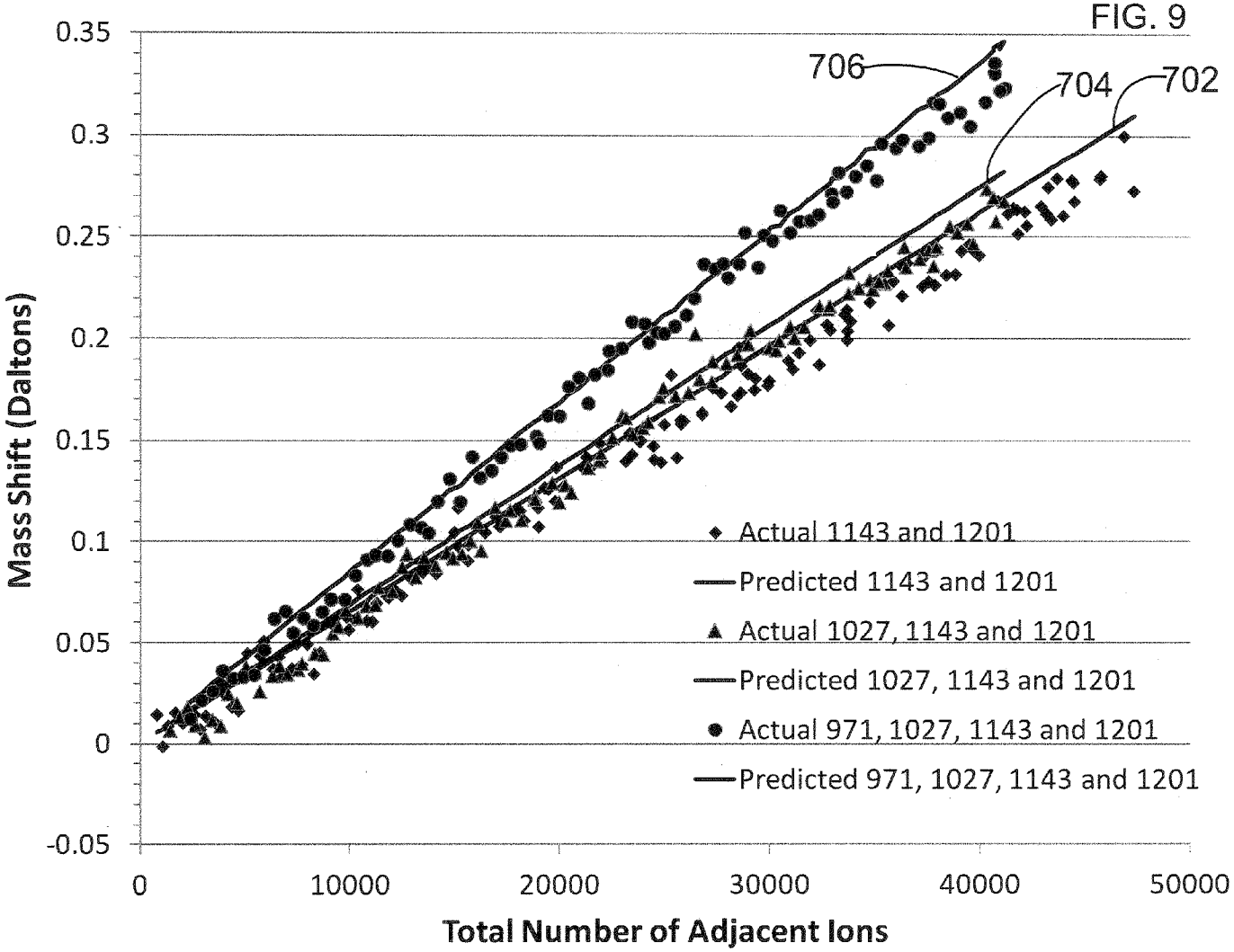
FIG. 9 is a graph illustrating the mass shift of an analyte as a function of a total adjacent ion population where the total adjacent ion population has either m/z 1143 and 1201 (diamonds); m/z 1027, 1143, and 1201 (triangles); or m/z 971, 1027, 1143, and 1201 (circles)

Using a mass spectrometer, the mass shift slopes ($A(M_i-M_0)$) were separately measured for four adjacent ions (m/z 971, 1027, 1143, and 1201) in the presence of a nominal analyte concentration (m/z 969). FIG. 9 is a graph showing the mass shifts that were measured with two or more adjacent ions (denoted as diamonds for m/z 1143 and 1201) simultaneously in the ion trap where the total ion population was increased. Note that the total ion population was increased such that the proportion of each adjacent ion m/z was approximately equal in the ion trap. For example, at a total adjacent ion population of 30,000 with analyte ion species m/z 969 and adjacent ion species having a m/z of 1143 and 1201, there would be about 15,000 ions for each of the adjacent species of ions, and a nominal number of analyte ions (~1000). FIG. 9 also shows the measured mass shifts for the situations in which there were three adjacent ion species (denoted as triangles for a m/z of 1027, 1143 and 1201) and four adjacent ions species (denoted as circles for a m/z of 971, 1027, 1143 and 1201) in the ion trap. In addition to measuring mass shifts, a predicted mass shift was calculated using Equation 8 for the three combinations and denoted on the graph of FIG. 9 as three straight lines overlaid with the actual measured data points. The three straight lines 702, 704, and 706 correspond to the data from the diamonds, triangles, and circles, respectively, as illustrated in FIG. 9.

The good correlation with the predicted and actual mass shifts illustrates that the effects of single species of isolated adjacent ions on the analyte can be combined, demonstrating the linearity of their influences. The quality of the model can be quantified by using the RMS difference between the predicted and measured mass shifts. Using this metric, the data sets of FIG. 9 had RMS errors of 0.012 Daltons (m/z 1143 and 1201), 0.010 Daltons (m/z 1027, 1143 and 1201), and 0.009 Daltons (m/z 971, 1027, 1143 and 1201) indicating a good correlation between the predicted and measured mass shifts.

Example 2

Figure 10:
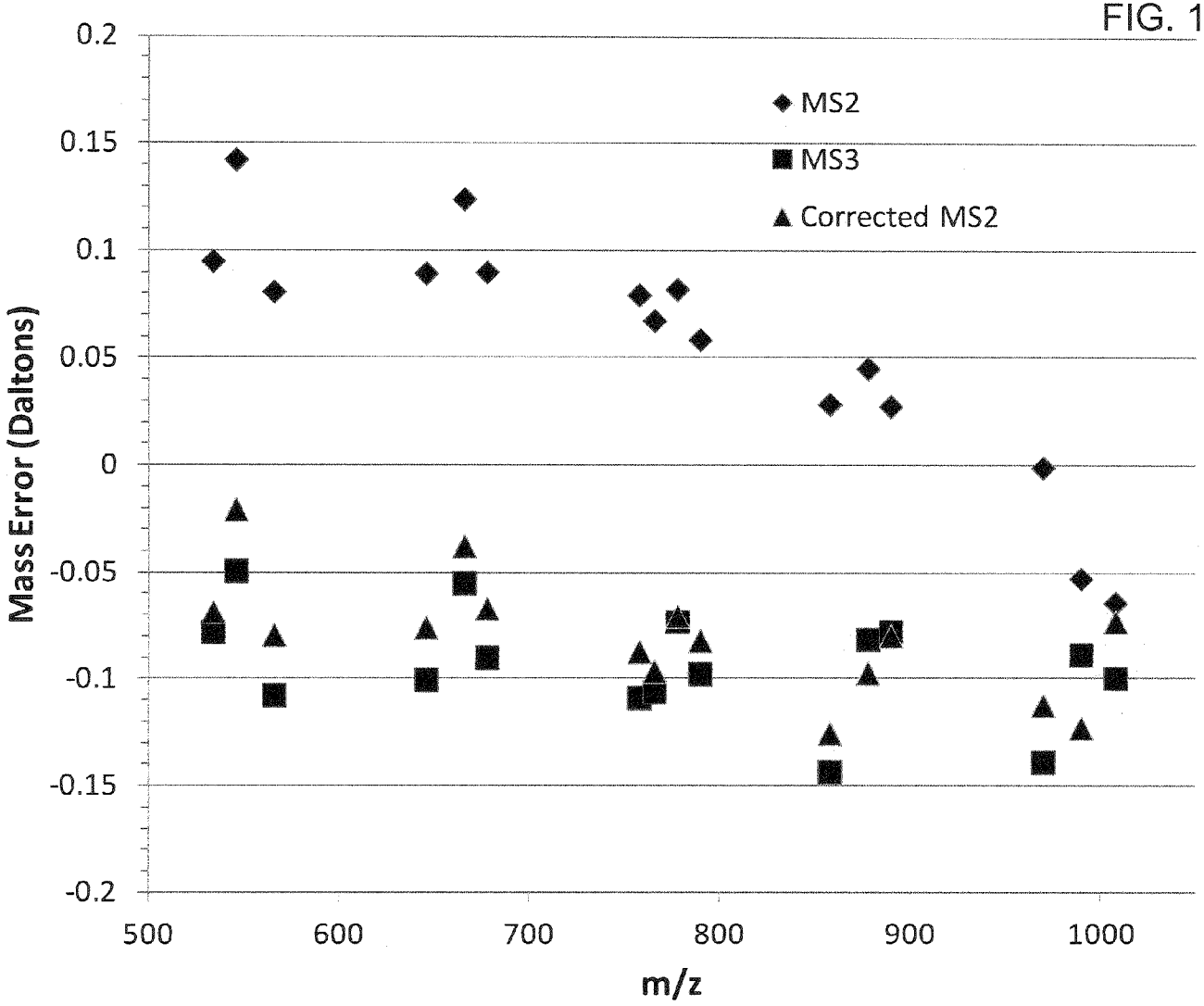
FIG. 10 is a graph illustrating mass errors for a MS2 scan (diamonds), a MS3 scan (squares) of individual product ions, and a corrected MS2 scan (triangles) that has been adjusted for space charge effects.

To show that the space-charge correction procedure is valid for arbitrary mixtures of ions, MS/MS spectra were acquired in a LTQ Velos linear ITMS at a scan rate of 33 kDa/s. The analyzed chemical was Ultramark 1621, which is a commercially available mixture of fluorinated phosphazines. A particular peak with a m/z of 1122 was selected and then fragmented to generate product ions. Next, the product ions were analyzed to generate a mass spectrum. The MS/MS spectra were obtained with a target ion population of $3\times10^4$ ions, which is about three times greater than normal. Because the true m/z values of the product ions can be easily determined from the phosphazine chemical structure, the mass error can be determined and is depicted on FIG. 10 (denoted as MS2 and graphed as diamonds).

Referring back to FIG. 10, the MS2 mass errors exhibit a characteristic shape, where the lower mass-to-charge ratio ions have greater error than the larger mass-to-charge ratio ions, since at the moment of ejection there was a greater abundance of adjacent ions for the low mass-to-charge ratio ions. Clearly, at a relatively high ion concentration of $3\times10^4$ ions, there is significant mass error for MS2.

An adjacent ion calibration was performed for only one analyte species at m/z 524, and applied for all product ion masses, i.e. coefficients d, f, and g in Equation 6 were treated as being not mass dependent. Using Equation 7, corrected m/z values were calculated for the mass spectrum. The mass error was determined for each of the corrected m/z values with respect to the true m/z values and depicted on FIG. 10 (denoted as Corrected MS2 and graphed as triangles). The mass error for the Corrected MS2 values (triangles) showed an increase in accuracy when compared to the uncorrected MS2 values (diamonds).

In addition to MS2 measurements, MS3 scans were performed for each product ion separately. The measured mass positions in MS3 should have less mass error than the MS2 measurements. In MS3, the overall mass perturbation is much smaller because the main effect is from the self space charge and with a relatively small or non-existent adjacent ion space charge effect. Thus, the MS3 scan serves as a standard by which to judge the quality of the space-charge correction. The mass error was determined for each of the m/z values collected with MS3 with respect to the true m/z values and depicted on FIG. 10 (denoted as MS3 and graphed as squares). Ideally, the MS3 error should be approximately zero across the m/z range and giving an approximately horizontal line in FIG. 10. The MS3 error shows a modest negative bias at the higher m/z value, but this error would be eliminated once a calibration of the mass scale was performed.

The Corrected MS2 mass error values overlap well with the MS3 mass error values, demonstrating the error reduction using Equation 7. Thus, the space-charge correction has improved the mass accuracy to be within about 0.15 Daltons or less, while increasing the dynamic range of the instrument by about a factor of 3 (i.e., increased from about $1\times10^4$ ions to about $3\times10^4$ ions).

The improvement in mass accuracy with the space-charge correction method can be quantified, with respect to MS3 error, based on a root-mean-square error calculation. As mentioned previously, the MS3 experiment serves as a reference standard because space charge interactions are at a minimum for an isolated ion of modest intensity. The root-mean-square error (RMSError) can be calculated using Equation 10, $$RMSError = \sqrt{\frac{1}{N}\sum_{i=1}^{N}(\text{error}[i] - ms3Error[i])^2} \quad \text{(Eq. 10)}$$

where error[ ] is the vector of mass error values (MS2 or Corrected MS2 error in FIG. 10), and ms3Error[ ] is the vector of reference error values from the MS3 experiment. Using Equation 10, the RMSError of the MS2 data set was about 0.157 Daltons, versus 0.021 Daltons for the Corrected MS2 data set. Thus, the corrected mass calculations using Equation 7 reduces mass error by about 6.5 times.

While preferred embodiments of the present invention have been shown and described herein, it will be apparent to those skilled in the art that such embodiments are provided by way of example only. Numerous variations, changes, and substitutions will now occur to those skilled in the art without departing from the invention. While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. Therefore, to the extent there are variations of the invention, which are within the spirit of the disclosure or equivalent to the inventions found in the claims, it is the intent that this patent will cover those variations as well.

What is claimed is:

1. A method of determining a mass-to-charge ratio of an analyte in a sample, the method comprising:

a) obtaining a mass spectrum, where the mass-to-charge ratio of the analyte was measured in a presence of a first adjacent ion, the first adjacent ion comprising an ion having a mass-to-charge ratio that is different than the mass-to-charge ratio of the analyte, the mass spectrum comprising: i) a measured analyte mass-to-charge ratio, ii) a measured first adjacent ion mass-to-charge ratio, iii) a measured analyte abundance, and iv) a measured first adjacent ion abundance, b) determining a first mass-to-charge ratio difference by subtracting the measured first adjacent ion mass-to-charge ratio from the measured analyte mass-to-charge ratio; and c) calculating a corrected analyte mass-to-charge ratio based on i) the measured analyte mass-to-charge ratio, ii) the measured analyte abundance, iii) the first mass-to-charge ratio difference, and iv) the measured first adjacent ion abundance, in accordance with the relationship:

$$M_{corrected}(M_0)=M_0-\Delta m(M_0),$$

where $M_0$=a measured anal to mass-to-charge ratio $\Delta m$=a mass correction offset.

2. The method of claim 1 further comprising:

d) determining a self charge space correction based on the measured analyte mass-to-charge ratio and the measured analyte abundance;

e) determining an adjacent ion space charge correction based on the first mass-to-charge ratio difference and the measured first adjacent ion abundance;

f) summing together the self charge space correction and the adjacent ion space charge correction to form a space charge correction; and g) calculating the corrected analyte mass-to-charge ratio by adding together the space charge correction and the measured analyte mass-to-charge ratio.

3. The method of claim 2, in which the self charge space correction comprises a product of a self charge space factor and the measured analyte abundance.

4. The method of claim 2, in which the self charge space correction is determined using an equation, the equation comprising:

$$\text{Self charge Space Correction}=S(M_0)\times I[M_0],$$

where $S(M_0)$ is a self charge space factor and $I[M_0]$ is the measured analyte abundance at the measured analyte mass-to-charge ratio $M_0$.

5. The method of claim 4, in which the self charge space factor is determined using a mathematical formula, the mathematical formula comprising:

$$S(M_0) = a + b \times \exp\left(\frac{M_0}{c}\right),$$

where a, b, and c are constants.

6. The method of claim 2, in which the adjacent ion space charge correction comprises a product of a first adjacent ion space charge factor and the measured first adjacent ion abundance.

7. The method of claim 5 further comprising:

determining the constants a, b, and c by using regression analysis based on at least;

a first and second measured analyte mass spectral position that are measured at a respective first and second analyte concentration; and a first and second measured analyte intensity that are measured at the respective first and second analyte concentration.

8. The method of claim 2, in which the adjacent ion space charge correction is determined using an equation, the equation comprising:

$$\text{Adjacent Ion Space Charge Correction}=A(M_i-M_0)\times I[M_i],$$

where $A(M_i-M_0)$ is an adjacent ion space charge factor and $I[M_i]$ is the measured first adjacent ion abundance at the measured first adjacent ion mass-to-charge ratio $M_i$.

9. The method of claim 8, in which the adjacent ion space charge factor is determined using a mathematical formula, the mathematical formula comprising:

$$A(M_i - M_0) = d + f \times \exp\left(\frac{M_i - M_0}{g}\right),$$

where d, f, and g are constants.

10. The method of claim 9 further comprising:

determining the constants d, f, and g by using regression analysis based on at least a measured first and second analyte mass spectral position that are measured at a nominal analyte concentration containing a respective first and second adjacent ion concentration; and a measured first and second adjacent ion intensity that are measured at the nominal analyte concentration containing the respective first and second adjacent ion concentration.

11. The method of claim 2, in which the mass-to-charge ratio of the analyte was measured in a presence of both the first adjacent ion and a second adjacent ion, the first adjacent ion comprising an ion having a mass-to-charge ratio that is different than the mass-to-charge ratio of the analyte and of the second adjacent ion, the second adjacent ion comprising an ion having a mass-to-charge ratio that is different than the mass-to-charge ratio of the analyte and of the first adjacent ion, the method further comprising:

h) determining a second mass-to-charge ratio difference by subtracting the measured second adjacent ion mass-to-charge ratio from the measured analyte mass-to-charge ratio; and i) determining an adjacent ion space charge correction based on the first mass-to-charge ratio difference, the second mass-to-charge ratio difference, the measured first adjacent ion abundance, and the measured second adjacent ion abundance.

12. The method of claim 11, in which the adjacent ion space charge correction comprises a summation of a first product and a second product, the first product including a multiplication of a first adjacent ion space charge factor and the measured first adjacent ion abundance, and the second product including a multiplication of a second adjacent ion space charge factor and the measured second adjacent ion abundance.

13. The method of claim 11, in which the adjacent ion space charge correction is determined using an equation, the equation comprising:

$$\text{Adjacent Ion Space Charge Correction}=A(M_1-M_0)\times I[M_1]+A(M_2-M_0)\times I[M_2]$$

where $A(M_1-M_0)$ is a first adjacent ion space charge factor, $A(M_2-M_0)$ is a second adjacent ion space charge factor, $I[M_1]$ is the measured first adjacent ion abundance, and $I[M_2]$ is the measured second adjacent ion abundance.

14. A method of determining a mass-to-charge ratio of an analyte in a sample, the method comprising:

a) obtaining a mass spectrum, where the mass-to-charge ratio of the analyte was measured in a presence of a first adjacent ion, the first adjacent ion comprising an ion having a mass-to-charge ratio that is different than the mass-to-charge ratio of the analyte, the mass spectrum comprising: i) a measured analyte mass-to-charge ratio, ii) a measured first adjacent ion mass-to-charge ratio, iii) a measured analyte abundance, and iv) a measured first adjacent ion abundance, b) determining a first mass-to-charge ratio difference by subtracting the measured first adjacent ion mass-to-charge ratio from the measured analyte mass-to-charge ratio; and c) calculating a corrected analyte mass-to-charge ratio based on i) the measured analyte mass-to-charge ratio, ii) the first mass-to-charge ratio difference, iii) the measured first adjacent ion abundance, in accordance with the relationship:

$$M_{corrected}(M_0)=M_0-\Delta m(M_0),$$

where $M_0$=a measured analyte mass-to-charge ratio $\Delta m$=a mass correction offset.

15. The method of claim 14 further comprising:

d) determining an adjacent ion space charge correction based on the first mass-to-charge ratio difference and the measured first adjacent ion abundance; and e) calculating the corrected analyte mass-to-charge ratio by adding together the adjacent ion space charge correction and the measured analyte mass-to-charge ratio.

16. A system to determine a mass-to-charge ratio of an analyte in a sample, the system comprising:

a) a mass spectrometer configured to measure a mass spectrum of the analyte in a presence of a first adjacent ion, the first adjacent ion comprising an ion having a mass-to-charge ratio that is different than the mass-to-charge ratio of the analyte, the mass spectrum including i) a measured analyte mass-to-charge ratio, ii) a measured first adjacent ion mass-to-charge ratio, iii) a measured analyte abundance, and iv) a measured first adjacent ion abundance, b) a microprocessor configured to receive the mass spectrum from the mass spectrometer and to output a corrected analyte mass-to-charge ratio based on i) the measured analyte mass-to-charge ratio, ii) the measured analyte abundance, iii) the measured first adjacent mass-to-charge ratio, and iv) the measured first adjacent ion abundance, v) a first mass-to-charge ratio difference that is a difference between the measured first adjacent ion mass-to-charge ratio and the measured analyte mass-to-charge ratio, in accordance with the relationship:

$$M_{corrected}(M_0)=M_0-\Delta m(M_0),$$

where $M_0$=a measured anal to mass-to-charge ratio $\Delta m$=a mass correction offset.

17. The system of claim 16, in which the microprocessor is incorporated into a computer.

18. The system of claim 16, in which the microprocessor is further configured to determine a self charge space correction based on the measured analyte mass-to-charge ratio and the measured analyte abundance; determine an adjacent ion space charge correction based on the first mass-to-charge ratio difference and the measured first adjacent ion abundance; sum together the self charge space correction and the adjacent ion space charge correction to form a space charge correction; and calculate the corrected analyte mass-to-charge ratio by adding together the space charge correction and the measured analyte mass-to-charge ratio.

* * * * *